US007485842B2

(12) United States Patent
Bich et al.

(10) Patent No.: US 7,485,842 B2
(45) Date of Patent: Feb. 3, 2009

(54) OPTICAL PROXIMITY SENSOR FOR A LIQUID-JET INSTRUMENT, AND A LIQUID-JET INSTRUMENT EQUIPPED WITH SUCH A SENSOR

(75) Inventors: Xavier Bich, Neuilly sur Seine (FR); Alain Rosenzweig, Saint Maur des Fosses (FR); Kurt Rath, Herblay (FR)

(73) Assignee: Societe BIC, Clichy Cedex (FR)

( * ) Notice: Subject to any disclaimer, the term of this patent is extended or adjusted under 35 U.S.C. 154(b) by 73 days.

(21) Appl. No.: 11/577,907

(22) PCT Filed: Oct. 20, 2005

(86) PCT No.: PCT/EP2005/011290

§ 371 (c)(1),
(2), (4) Date: Jun. 22, 2007

(87) PCT Pub. No.: WO2006/045531

PCT Pub. Date: May 4, 2006

(65) Prior Publication Data

US 2007/0246666 A1 Oct. 25, 2007

(30) Foreign Application Priority Data

Oct. 25, 2004 (FR) ..... 04 11358

(51) Int. Cl.
*G01J 1/04* (2006.01)

(52) U.S. Cl. ..... 250/227.13; 250/239

(58) Field of Classification Search ..... 250/227.13, 250/239, 221, 559.29, 559.3; 347/8, 9, 107–109; 401/195, 44–52
See application file for complete search history.

(56) References Cited

U.S. PATENT DOCUMENTS 4,412,232 A * 10/1983 Weber et al. ..... 347/68
4,721,384 A 1/1988 Dietrich et al.
2004/0052569 A1 3/2004 Bich et al.

FOREIGN PATENT DOCUMENTS

FR 2 841 498 1/2004

* cited by examiner

*Primary Examiner*—Que T Le
(74) *Attorney, Agent, or Firm*—Jones Day

(57) ABSTRACT

An optical proximity sensor adapted to be mounted in a liquid-jet instrument having a spray head for spraying a jet of liquid. The optical sensor evaluates a distance between the sensor and a surface onto which the liquid is to be sprayed.

23 Claims, 3 Drawing Sheets

OPTICAL PROXIMITY SENSOR FOR A LIQUID-JET INSTRUMENT, AND A LIQUID-JET INSTRUMENT EQUIPPED WITH SUCH A SENSOR

FIELD OF THE INVENTION

This application is a national stage application of PCT/EP2005/011290, filed on Oct. 20, 2005, which claims priority to patent application FR No. 04 11358 filed on Oct. 25, 2004, the entire contents of which are incorporated by reference herein.

The embodiments of the present invention relate to optical proximity sensors for a liquid-jet instrument that spray jets of liquid, and also to a liquid-jet instrument equipped with such optical sensors.

BACKGROUND OF THE INVENTION

More particularly, the embodiments of the present invention relates to an optical proximity sensor adapted to be mounted in a liquid-jet instrument having a spray head for spraying of jet of liquid, the optical senor serving to evaluate a distance between it and a given surface onto which the liquid is to be sprayed.

French Patent Application FR 2 841 498 describes, in particularly, a writing instrument that includes such an optical sensor which can, for example, be formed by an infrared light-emitting diode (LED) which sends an incident light beam towards the given surface so as to form a light spot on said given surface and a reflected light beam which is then received, for example, by a photodiode which then issues a signal representing the reflected light beam. The signal representing the reflected light beam is then analyzed by a processor unit in order to evaluate the distance between the optical sensor and the given surface in order to trigger or not to trigger activation of the liquid spray head so as to spray or not spray a certain quantity of liquid onto the given surface, such as a writing surface.

In known writing instruments, the light-emitting element of the optical sensor can be mounted in the writing instrument anywhere that is in the vicinity of the spray head, and the light-receiving element is also mounted on any support that can be different while also being situated in the vicinity of the spray head. It can thus be understood that mounting the various light-emitting and light-receiving elements one after another complicates mounting the optical sensor as a whole on the liquid-jet instrument without being certain that the light-emitting and the light-receiving elements are always in the same relative positions. That uncertainty as to the relative positions of the light-emitting and of the light-receiving elements can give rise to errors in evaluating the distance between the optical sensor and the given surface, which also modifies the sensitivity of the optical sensor from one liquid-jet instrument to another.

OBJECTS AND SUMMARY OF THE EMBODIMENTS OF THE PRESENT INVENTION

An object of the embodiment of the present invention is to mitigate the above-mentioned technical problems by proposing an optical sensor and a liquid-jet instrument, the optical sensor being more reliable, simple, and guaranteeing that the distance between the given surface and the optical sensor is always evaluated in the same manner from one optical sensor to another and thus from one liquid-jet instrument to another.

To this end, the embodiments of the invention provide an optical proximity sensor characterized in that it comprises:

a printed circuit having a first face and a second face on which at least one light-emitting element and at least one light-receiving element are positioned, the light-emitting and the light-receiving elements being adapted to make it possible to evaluate the distance between them and the given surface;

an intermediate part that is mounted on the second face of the printed circuit, and that is provided with at least two through recesses in which the light-emitting and the light-receiving elements of the printed circuit are received; and protective means that cover at least one of the two through recesses, the protective means presenting optical properties adapted to the wavelength of the light used by the light-emitting and the light-receiving elements so as to enable the light to be focused;

the printed circuit and the intermediate part are provided with through holes which are mutually superposed to form a passageway serving to enable the liquid to be sprayed from the liquid spray head.

By means of these provisions, the light-emitting and the light-receiving elements forming the optical sensor are systematically disposed on the same printed circuit disposed against a part, thereby making it possible to define their relative positions in advance because of the rigidity of the printed circuit and/or of the intermediate part. The sensitivity of the sensor is thus improved, while using a conventional technique of assembling electrical elements on a printed circuit board or strip, thereby also making it possible to reduce the cost of manufacturing the optical sensor. In addition, the presence of the intermediate part and of the protective means also makes it possible to offer a protective function for protecting the light-emitting and the light-receiving elements which are relatively fragile, in order to avoid them being irreparably damaged while the sensor is in use, while also offering an optical function by means of the optical properties of the protective means, which, properties are adapted to the wavelength of the light used, in particular to enable the light to be focused onto the given surface, such as a writing medium, for example. Finally, by means of these provisions, the printed circuit, the intermediate part, and the protective means can be assembled and fastened together in order to obtain an optical sensor forming a pre-assembled unit serving to be placed directly in the writing instrument, and offering a passageway serving to enable the liquid to be sprayed through the optical sensor. In addition, the liquid spray head of the liquid-jet instrument can also be displayed on the second face of the printed circuit and immediately facing the passageway or even inside the passageway, thereby enabling the various light-emitting and light-receiving elements to be disposed very close to the liquid spray head in order to evaluate exactly the conditions determining whether or not liquid is to be sprayed, as a function of the distance between the spray head and the given writing surface.

In preferred embodiments of the present invention, use is further made of one or more of the following provisions:

the printed circuit comprises a rigid board disposed against the intermediate part, and conductive tracks preferably formed on the first face of the printed circuit;

the printed circuit is a flexible strip that is secured to the intermediate part, and that is provided with conductive tracks preferably formed on the second face of the printed circuit;

the conductive tracks are adapted to power the light-emitting and the light-receiving elements, and to convey the signals from said at least: one light-receiving element to a processor unit;

the printed circuit and the intermediate part are fastened together by adhesive bonding;

the intermediate part and the protective means are fastened together by adhesive bonding;

the second face of the printed circuit is provided with a plurality of light-emitting and light-receiving elements, the intermediate part is provided with a plurality of through recesses in which the plurality of light-emitting and light-receiving elements are received, and the protective means cover said plurality of recesses;

the protective means are in the form of a transparent plate;

the transparent plate is obtained directly by overmolding a transparent material on the intermediate part;

a refractive matching material is disposed between the protective means and the light-emitting and light-reeving elements, in order to minimize refractive index discontinuities;

the refractive index matching material is made of a rubber silicone;

the protective means cover said at least one through recess in which the at least one light-emitting element is received, the protective means presenting optical properties adapted to the wavelength of the light used in order to enable the emitted light to be focused onto the given surface;

the protective means cover the at least one recess in which the at least one light-receiving element is received, the protective means having optical properties adapted to the wavelength of the light used in order to enable the received light to be focused toward the at least one light-receiving element;

the sensor has at least two light-receiving elements, and the protective means have a first zone adapted to focus the received light towards the at least two light-receiving elements in a first manner, and a second zone adapted to focus the received light towards the other of the at least two light-receiving elements in a manner different from the first manner;

the first and second zones of the protective means are respectively first and second facets presenting profiles that are different;

a light barrier is arranged between said at least: one light-emitting element and the at least one light-receiving element, thereby preventing the light emitted by the light-emitting element and diffused or reflected in the sensor from reaching the light-receiving element and from disturbing the distance evaluation;

the intermediate part has a front face which is on the opposite side from its face facing the printed circuit and in which the through recesses open out, and the light barrier comprises a projection arranged on the front face of the intermediate part between the outlet of a recess in which the at least one light-emitting element is received and the outlet of a recess in which the at least one light-receiving element is received;

the projection, which is preferably formed integrally with the intermediate part, extends across the front face and subdivides the face into a first portion in which all of the recesses receiving light-emitting elements open out, and a second portion in which all of the recesses receiving light-receiving elements open out;

the protective means comprise at least one one-piece part, the one-piece part covering only those recesses which receive light-emitting elements, or only those recesses which receive light-receiving elements, thereby preventing transmission of light from the light-emitting element to the light-receiving element upon multiple reflections within he protective means;

the protective means are provided with a through hole superposed on the through holes in the printed circuit and in the intermediate part; and the recesses in the intermediate part have walls shaped to optimize the guiding of the light emitted by said at least one light-emitting element and/or received by said at least one light-receiving element.

In addition, the embodiments of the present invention also provide a liquid-jet instrument comprising a liquid spray head, a processor unit, and an optical proximity sensor as defined above.

Other characteristics and advantages of the invention appear from the following description of embodiments given by way of non-limiting examples and with reference to the accompanying drawings.

In the various figures, like references designate elements that are identical or similar.

DETAILED DESCRIPTION OF THE DRAWINGS

Figure 1:
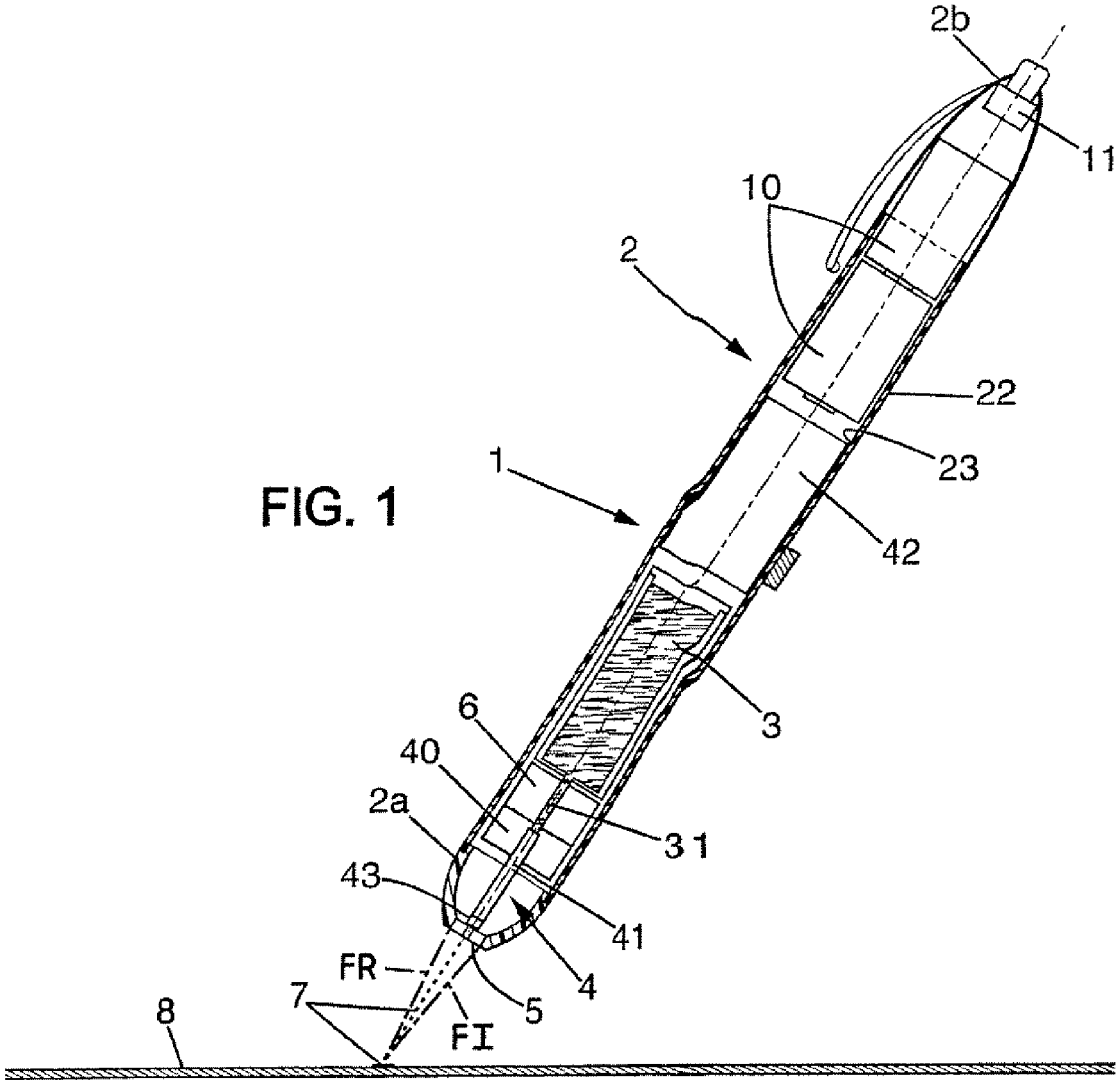
FIG. 1 is a diagrammatic section view of a liquid-jet instrument equipped with an optical proximity sensor of the invention.

FIG. 1 shows a liquid-jet instrument 1 which, in the example considered herein, is in the form of a writing instrument 1 that includes a substantially tubular element 2 which extends between a first end 2*a* and a second end 2*b*. The tubular element 2 has in inside wall 23 defining a hollow inside space, and an outside wall 22 designed to be held by a user.

The hollow inside space defined by the inside wall 23 of the tubular element 2 contains a reservoir of liquid 3 and a spray system 4 for spraying said liquid, said spray system being associated directly with the reservoir 3. The reservoir of liquid 3 is removably mounted in the hollow inside space in the tubular element so as to be replaced with another reservoir after said liquid has been used up. Depending on the use to be made of the instrument, the liquid contained in said reservoir can be formed of ink, or of an ink-erasing or ink-masking liquid when the instrument is used as a corrector, or even of adhesive when said instrument is used as an adhesive applicator or spray. The spray system 4 is formed by a liquid feed channel 41 connected directly to the reservoir of liquid 3 via a channel 31, and by an electrical signal generator 42 designed to control activation and deactivation of a spray head 43 situated at the end of the feed channel 41 of the spray system.

In the example considered herein, the spray head 43 is a thermal-effect spray head that has at least one spray nozzle disposed at the end 2*a* of the tubular element 2. It could be constituted by any other type of spray head, and in particular by an electrostatic head offering higher efficiency. Said end 2*a* of the tubular element can be constituted by an end-piece fitted directly into the central portion of the tubular element 2 over the inside wall 23 of said central portion. Said end-piece 2*a* presents an end orifice 2*c* via which provision is made for the spray head 43 to spray droplets of liquid 7 onto a given surface 8 which, in the example considered herein, is formed by a writing surface such as a sheet of paper.

The liquid-jet instrument also includes a processor unit 6 designed to activate the generator 42 for generating electrical signals (or electrical pulses) in order to enable the spray nozzle 43 of the spray system to spray the droplets 7 onto the medium 8 from a distance. At its end 2*b*, the hollow inside space of the tubular element 2 also contains an electrical power source 10 formed, for example by a battery, or even two batteries, rechargeable or otherwise, making it possible, by means of a switch 11 to switch on the various electrical elements forming the writing instrument. The end 2*b* of the tubular element 2 can, for example, be in the form of a cap removably mounted on the central protion of said tubular element 2 in order to enable two worn batteries 10 to be replaced with new batteries.

At its end 2*a*, the tubular element 2 is also provided with an optical proximity sensor 5 adapted to be mounted in the through orifice 2*c* of the end 2*a* of the tubular element. Said optical proximity sensor 5 serves to evaluate the distance between it and the writing medium 8 on which the droplets of liquid 7 are to be sprayed.

The optical proximity sensor 5 of the invention is described in more detail below with reference to FIGS. 2 and 3 which show two variants of a first embodiment of the optical proximity sensor 5.

Figure 2:
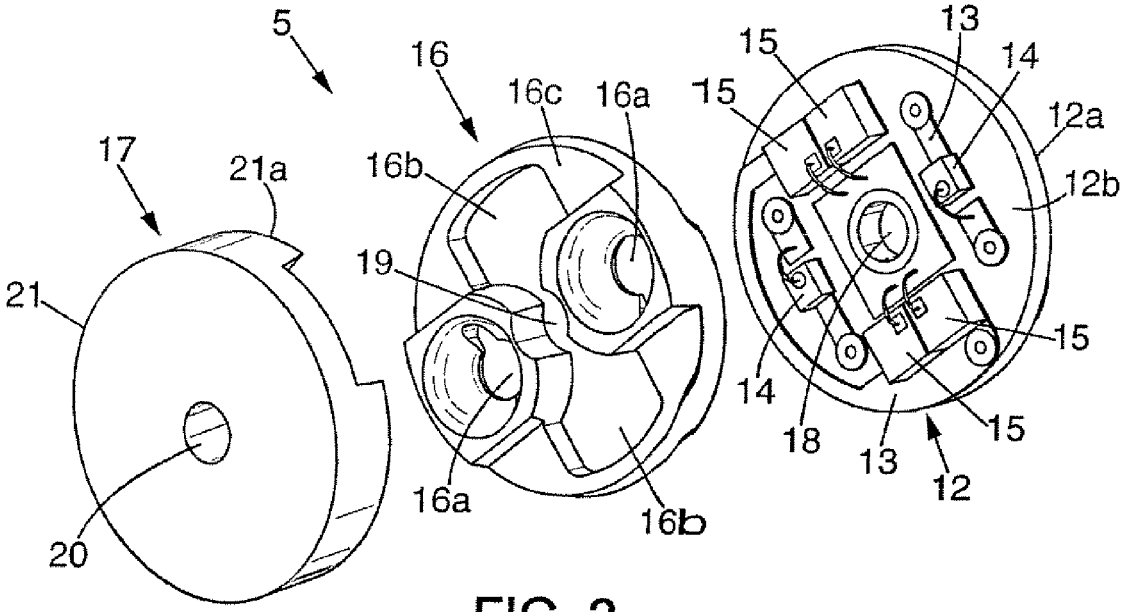
FIG. 2 is an exploded perspective view of the various component elements of a first variant of a first embodiment of the optical proximity sensor.

As can be seen in FIG. 2 which shows a first variant embodiment of the optical proximity sensor 5, said sensor includes a printed circuit 12. In known manner, the printed circuit 12 comprises a rigid board 12 representing a first face 12*a* facing towards the inside of the tubular element 2, and a second face 12*b* which is provided with a plurality of conductive tracks 13 to which light-emitting elements 14 and light-receiving elements 15 are electrically connected, said light-emitting elements and said light-receiving elements serving to be directed towards the writing medium 8 when the liquid-jet instrument is in the in-use position.

In the example considered herein, the printed circuit board 12, or more exactly its second face 12*b*, has two light-emitting elements 14 and four light-receiving elements 15. Naturally, the second face 12*b* of the printed circuit board 12 could have a single light-emitting element 14 and a single light-receiving element 15. The first face 12*a* of the printed circuit board 12 is also provided with conductive tracks (not shown in the drawings) for powering the light-emitting and light-receiving elements (14, 15) and for conveying the signals from the light-receiving elements 15 to a processor unit 6 as described in detail below.

The optical sensor 5 also includes an intermediate part 16 serving to be mounted in fixed manner on the second face 12*b* of the printed circuit board. For example, said intermediate part 16 is provided with two through recesses 16*a* which pass through its entire thickness and which serve to receive the two light-emitting elements 14, and with two recesses 16*b*, each of which serves to receive a pair of light-receiving elements 15. The intermediate part 16 is preferably rigid, e.g. made of a plastic material. However, in this embodiment in which the printed circuit 12 is a rigid board, it can be imagined for the intermediate part to be made of elastomer.

The optical sensor 5 also includes protective means 17 which, in the example considered herein, cover the entire intermediate part 16 so as to protect the light-emitting and the light-receiving elements (14, 15) from the outside. Said protective means 17 also have optical properties adapted to the wavelength of the light used by the light-emitting and the light-receiving elements (14, 15) for enabling the light to be focuses onto the writing medium 8 and more exactly onto zones that can be more or less point-like on the writing medium 8 onto which the droplets 7 are to be sprayed.

As can also be seen in FIG. 2, the printed circuit board 12, the intermediate part 16, and the protective means 17 are respectively provided with through holes (18, 19, 20) that are mutually superposed in order to form a passageway for enabling the liquid to be sprayed from the spray head 43 which is disposed immediately behind the first face 12*a* of the printed circuit board 12. The passageway formed by the through holes (18, 19, 20) can also receive the spray head 43 of the liquid spray system 4 in full or in part.

In the example shown in FIG. 2, the protective means 17 are in the form of a transparent plate or patch 21 that presents a face 21*a* that is of shape complementary to the shape of the face 16*c* of the intermediate part 16 on which it is designed to be mounted in fixed manner, i.e. the face opposite from the printed circuit 12 and facing the orifice 2*c*. Said transparent plate 21 has zones that can be machined or treated specifically and that are in register with the recesses 16*a* and 16*b* in the intermediate part 16 so as to make it possible to focus the light emitted from the two light-emitting elements 14 towards the writing medium 8 and to maximize reception of the light reflected by the medium 8 towards the light-receiving elements 15.

The protective means 17 can also be formed by a plurality of small transparent patches, each of which is disposed in a corresponding recess 16*a* or 16*b* in the intermediate part 16.

By way of example, the light-emitting means 14 can be formed by laser diodes of the Vertical Cavity Surface Emitting Laser (VCSEL) type or by infrared LEDs that send an incident light beam FI (see FIG. 1) toward the writing medium 8 so as to form a light spot on said medium 8 and a reflected light beam FR that is received by the light-receiving elements 15 formed, for example, by receiver phototransistors or photodiodes. The light-receiving elements 15 then send electrical signals that are representative of the received light to the processor unit so as to evaluate the distance between the proximity sensor 5 and the writing medium 8.

In addition, according to another characteristic of the invention, the intermediate part 16 can be made of a plastics material covered by a surface layer of metal so that, at the walls of the recesses 16*a* and 16*b*, reflective surfaces are formed around the light-receiving and the light-emitting elements 14, 15 so as to guide and to optimize light emission and light reception.

In addition, as can be seen in FIG. 2, the walls of the recesses 16*a* and/or 16*b* can be shaped, e.g. by having a substantially conical shape, in order to make it possible to optimize guiding the light emitted and received by the light-emitting and the light-receiving elements 14, 15.

In addition, prior to fastening the transparent plate 21 onto the intermediate part 16, a refractive matching material can be disposed inside the recesses 16*a* and 16*b* so as to avoid or reduce the refractive index discontinuities between the light-receiving and light-emitting elements 14, 15 and the outside of the writing instrument. Said refractive index matching material can be made, for example from silicon-based rubber.

The printed circuit board 12, the intermediate part 16, and the transparent plate or patch 21 can be fastened together by adhesive bonding.

In another variant embodiment, the plate or patch 21 can be obtained directly by overmolding a transparent material having suitable optical properties onto the intermediate part 16.

Thus, the optical proximity sensor 5 forms a pre-assembled unit that is deigned to be mounted in the opening 2*c* provided in the end 2*a* of the writing instrument (see FIG. 1). When the printed circuit board, the intermediate part 16, and the transparent plate 21 are circular in shape, the resulting optical proximity sensor 5 can be fastened directly by adhesive bonding or by any other suitable means into the opening 2*c* provided in the end 2*a* of the writing instrument.

The optical proximity sensor, or more exactly the printed circuit board, the intermediate part 16 and the transparent plate 21 can, for example, present an outside diameter of about 3 millimeters (mm) while the passageway formed by the through holes 18, 19, 20 can present a diameter of about 0.6 mm in order to enable the ink to pass from the ink spray head 43. The total thickness of the resulting optical sensor 5 can be about 1 mm. In addition, when the spray head 43 is provided with a plurality of spray nozzles, the passageway delimited by the through holes (18, 19, 20) can have some other, non-circular shape, e.g. oblong or rectangular.

Figure 3:
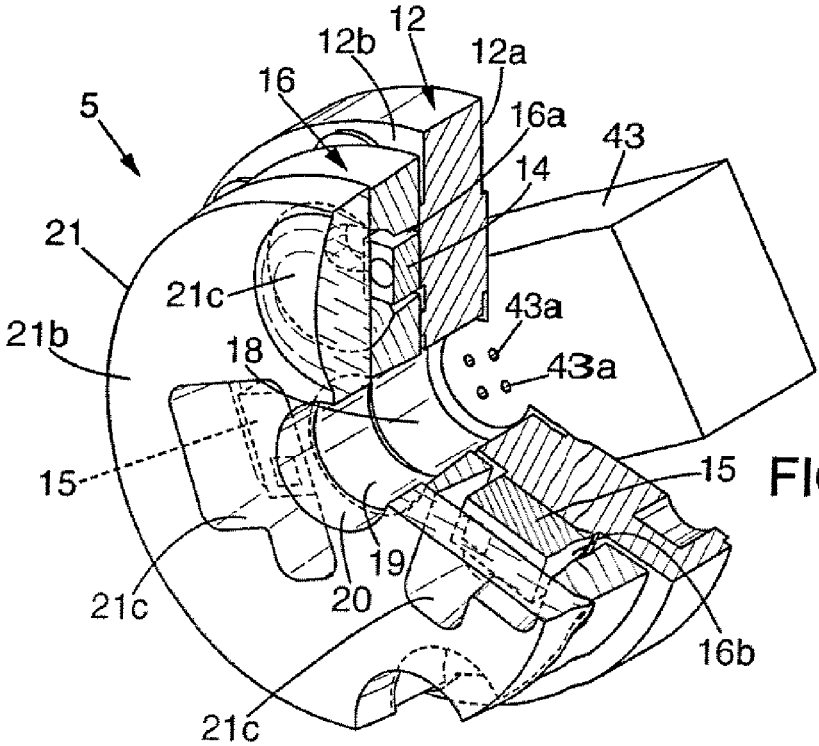
FIG. 3 is a view in second and in perspective of a second variant of the first embodiment of the optical proximity sensor when it is disposed on or in the vicinity of a liquid spray head of the instrument.

FIG. 3 shows a second variant of the first embodiment of the optical proximity sensor 5. In this variant embodiment, the face 12*b* of the printed circuit board 12 has a single light-emitting element 14 and two light-receiving elements 15 which are mounted and connected via suitable electrical connections such as wires onto the conductive tracks 13 which are connected to the other conductive tracks formed directly on the first face 12*a* of the printed circuit board 12. The functions of the conductive tracks on the first face 12*a* of the first printed circuit board 12 are to power the light-emitting and the light-receiving elements 14, 15, and to convey signals from the light-receiving elements 15 to the processor unit 6.

In this second variant embodiment, the intermediate part 16 is thus provided with a single through recess 16*a* for receiving the light-emitting element 14 and two through recesses 16*b* which serve to receive the light-receiving elements 15 of the printed circuit board 12.

In this example, the protective means 17 are also formed by a transparent plate or patch 21 mounted directly on the intermediate part 16, e.g. by adhesive bonding. As can be seen in FIG. 3, in register with the recesses 16*a* and 16*b* in the intermediate part 16, the patch 21, or more exactly its face 21*b* that is designed to face towards the writing medium 8, is provided with zones 21*c* that can be machined or treated specifically to enable the light emitted from the light-emitting element 15 to be focused optimally towards the writing medium 8, and to enable reception of the light reflected by the support 8 to be maximized by focusing towards the light-receiving elements 15.

In addition, as can be seen in FIG. 3, the liquid spray head 43 of the liquid spray system 4 is disposed directly against or in the vicinity of the first face 12*a* of the printed circuit board 12. For example, said spray head 43 can be provided with four spray nozzles 43*a* which are disposed directly facing the passageway formed by the through holes 18, 19, 20 formed in the printed circuit board 12, in the intermediate element 16 and in the transparent plate or patch 21. Naturally, the spray head 4 can be provided with a single spray nozzle 43*a* or with a plurality of spray nozzles 43*a*.

Figure 4:
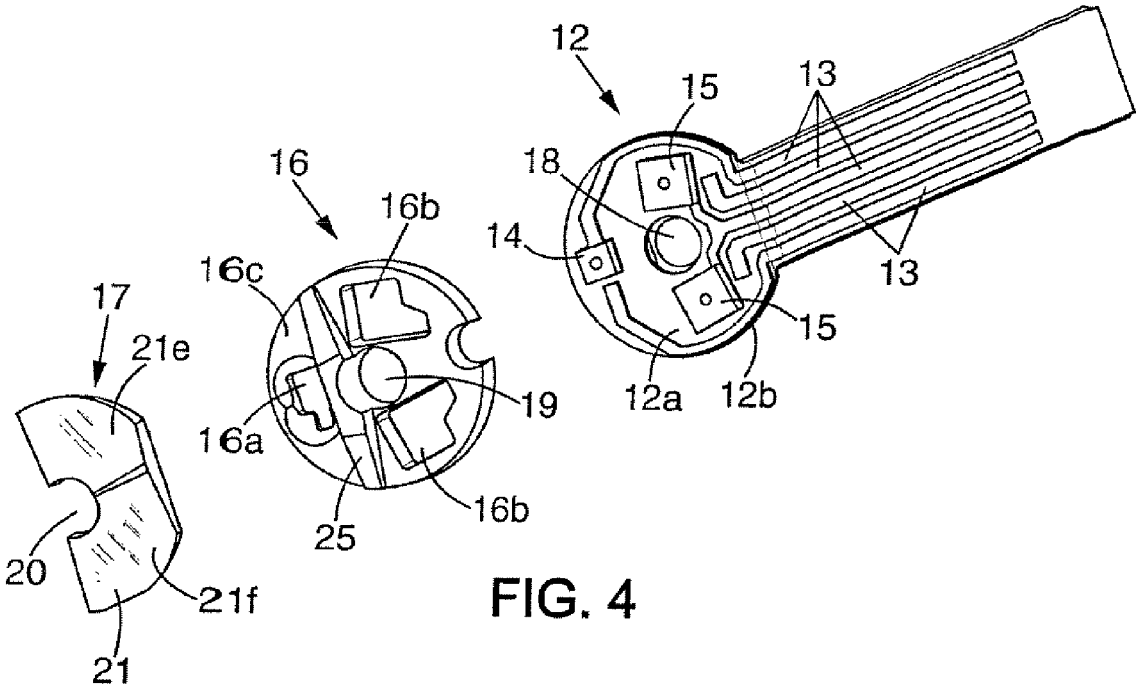
FIG. 4 is an exploded perspective view of the component elements of a second embodiment of the optical proximity sensor.
Figure 5:
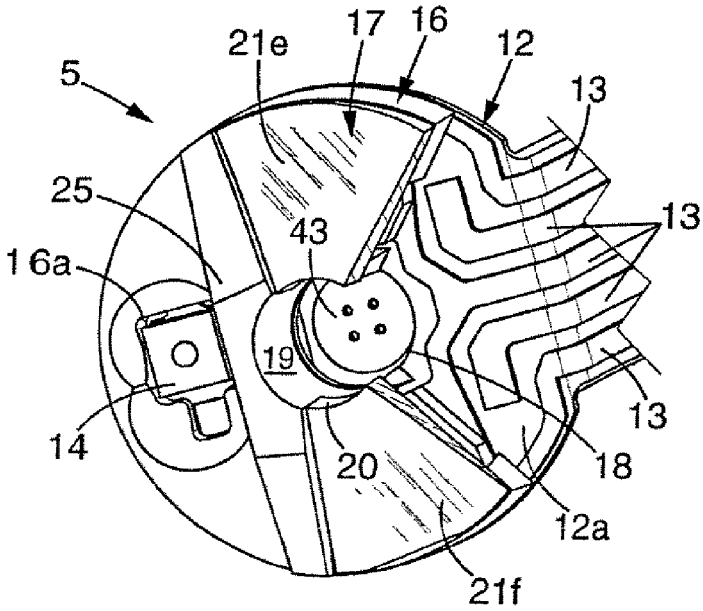
FIG. 5 is a cutaway view of the second embodiment of the optical sensor when it is disposed on or in the vicinity of a liquid spray head of the instrument.

FIGS. 4 and 5 show a second embodiment of the optical proximity sensor 5 of the invention. This embodiment essentially uses the same elements as the proceeding embodiment, and therefore only the differences are described in detail below.

In this example, the printed circuit 12 has as its backing a flexible backing strip that can be in form of a flexible sheet of a plastics material with the conductive tracks 13 formed on the second face 12*b*.

Light-emitting and light-receiving elements (14, 15) are fastened to the printed circuit backing strip 12 and are electrically connected to the conductive tracks 13. As in the preceding embodiment, the second face 12*b* is positioned against the intermediate part 16, and more precisely fastened by adhesive bonding against the rear face (not referenced) thereof. Mounting the light-emitting and the light-receiving elements (14, 15) on the printed circuit strip 12 guarantees that said elements are positioned properly relative to one another, and fastening the printed circuit strip against the intermediate part 16 guarantees that "the directions of said elements are fixed, due to the rigidity of said intermediate part. Like the first embodiment, the second embodiment thus makes it possible for the distance relative to the given medium 8 to be evaluated with precision. In addition, the strip forming the backing for the printed circuit 12 is small in thickness, and the spray head 43, also mounted against the first face 12*a*, is closer to the outlet of the spray channel formed by the holes (18, 19, 20) through the parts of the sensor 5. The use of a printed circuit strip 12 also offers the advantage of being able to establish an electrical connection between the sensor and the processor unit 6, by means of a tab 12*c* integrally formed with the printed circuit, and which can be curved back along the inside wall 23 of the tubular body of the instrument towards the rear end 2*b* thereof.

The light-emitting element 14 is analogous to the light-emitting elements of the first embodiment, but it presents the property of emitting a directional infrared beam, so that it is not necessary to dispose optical means facing said element 14 in order to focus the light onto the given medium 8.

It should be noted that, in this embodiment, no protective means cover the recess 16*a* in which the light-emitting element 14 is received, since the depth of the recess and the directional nature of the diode used, limit the risks of said diode being damaged. But, it is naturally possible to provide an optical part for forming protective means for protecting the light-emitting element 14.

For this second embodiment, two light-receiving elements 15 are provided on the printed circuit strip 12, and are disposed substantially opposite each other about the hole 18 so as to space apart the light-receiving elements 15. The recesses 16*b*, each of which receives one of the two light-receiving elements 15, are covered by a one-piece optical part 21. The one-piece part 21 forms protective means for all of the light-receiving elements 15 of the sensor. In this way, it is possible to avoid one of the light-receiving elements being damaged or having its frequency disturbed by any debris that might become lodged in the recesses 16*b*, and thus to avoid the electrical signal transmitted by the light-receiving means to the processor unit 6 not matching the light reflected by the given medium 8. As in the preceding embodiment, the protective means 17 have optical properties adapted to the wavelength of the light emitted by the light-emitting element 14 in order to focus the reflected light towards the corresponding light-receiving element. More particularly, in said second embodiment, the one-piece part 21 forming the protective means 17 is made of a transparent rigid plastics material, and it has facets (21*e*, 21*f*), each of which covers a respective one of the recesses 16*b* receiving respective ones of the light-receiving elements 15. Each of the facets (21*e*, 21*f*), which are plane in this example, acts as a prism. But said facets could be concave or convex. The facets (21*e*, 21*f*) can be of equal focal length corresponding substantially to the distance at which the liquid is to be sprayed. But preferably, the focal length f1 of facet 21*e* is slightly different from the focal length f2 of facet 21*f*. The signals sent to the processor unit by each of the light-receiving elements are thus different for the same received reflected beam. The difference between said signals can be used advantageously by the processor unit 6 in order to increase the precision of the distance evaluation over a given distance range, and in particular over the distance range within which it is desirable to cause liquid to be sprayed onto the given medium 8. For example, it is possible to choose the first focal length f1 to be close to the minimum distance at which the liquid is sprayed and to choose the focal distance f2 to be close to the maximum distance beyond which no liquid must be caused to be sprayed. The processor unit 6 is then adapted, by addition and/or subtraction of the signals received from each of the light-receiving elements 15, to evaluate whether the distance between the given medium 8 and the spray head 43 corresponds to the center of the desired range, or whether said distance is close to the allowed maximum distance or to the allowed minimum distance. Determined precision is thus obtained over a relatively wide distance range, and not merely around a single nominal distance as is obtained when protective means are used that focus the light identically for each of the light-receiving elements 15.

It should be noted that, for the second embodiment, the intermediate part 16 is provided with a projection 25 projecting from the front surface 16*c* of said part. Said projection 25 is formed integrally with the part 16 and it forms a light barrier between the light-emitting element 14 and the light-receiving elements 15. Anomalies have been observed in distance evaluation when the dimensions of the optical sensors are so small that the spacing between the light-emitting and tine light-receiving elements (14, 15) is about one millimeter. By forming a light barrier by means of the projection 25, such anomalies are considerably reduced. In addition to the walls of the recesses (16*a*, 16*b*), the projection 25 forms a light barrier that prevents a fraction of the light emitted by the light-emitting element(s) 14 from being received by the light-receiving elements 15 in almost direct manner by diffusion and/or reflection inside the optical sensor 5 itself, and in particular in the protective means 17. The fact that the projection 25 is formed integrally with the intermediate part 16 reduces the number of components of the sensor. But, it can be advantageous, in a variant embodiment (not shown), to form the barrier 25 by means of a separate part, optionally made of material different from the material of the intermediate part, in order to improve the extent to which the light diffusion is stopped.

The light barrier formed by the projection 25 extends along a chord of the optical sensor that is substantially disk-shaped, and thus subdivides the front face 16*c* of the intermediate part 16 into a first zone into which the recess 16*a* that receives the light-emitting element 14 opens out, and a second zone into which the recesses 16*b* that receive light-receiving elements 15 open out. The projection 25 thus forms single barrier between the two types of elements, namely the light-emitting type and the light-receiving type. But, in a variant, it is quite possible to provide one or more barriers that extend to greater or lesser extents between the outlet of a recess 16*a* receiving a light-emitting element 14 and the outlet of one or more recesses 16*b*, each of which receives a light-receiving element 15.

For the same reason, it is also preferably for the one-piece part 21 that constitutes the protective means 17 to cover the light-receiving elements 15 only, or alternatively, to cover the light-emitting elements only. In the embodiment shown, the one-piece part 21 covers all of the light-receiving elements 15, but, in a variant, it could cover some of them only. Naturally, the protective means 17 can comprise a plurality of one-piece optical parts, but, it is then preferable for one of said parts that covers the light-emitting element(s) 14 not to cover one of the light-receiving elements 15 as well, and vice versa.

The optical proximity sensor 5, as implemented in one of the above-described embodiments, is disposed at the end 2*a* of the liquid-jet instrument, and said sensor is connected via the first or the second face (12*a*, 12*b*) of the printed circuit to the processor unit 6 which, for example, is adapted to activate the spray head 43 of the spray system 4 when the distance between the optical proximity sensor 5 and the medium is evaluated as being a suitable distance for enabling droplets of liquid 7 to be sprayed onto the writing medium 8. Conversely, if the distance evaluated by the optical sensor does not lie within a range of predetermined distances, the processor unit 6 can then be adapted not to activate or to stop spraying of droplets 7.

As can be seen in FIG. 1, the tubular element 2 can also be provided with movement or displacement detector means 40 for detecting movement or displacement of the liquid-jet instrument. Such movement or displacement detector means 40 for detecting movements or displacement of the liquid-jet instrument can, by way of example be formed by an accelerometer 40 connected directly to the processor unit 6 and that can be disposed anywhere inside said tubular element 2. By way of example, the accelerometer can be disposed at the end 2*b* of the tubular element so as to be subjected to the movements that have the largest amplitude when the user is using the liquid-jet implement.

When the liquid-jet or writing instrument 1 is provided with displacement or movement detector means 40, the processor unit 6 can then be adapted to activate the liquid spray head 43 firstly when the optical proximity sensor 5 evaluates or determines that the distance between it and the writing medium 8 lies within a suitable distance range, and secondly when the accelerometer 14 detects movement of the tubular element 2.

In which case, the writing instrument can operate in the same way as described in French Patent Application FR 2 841 498, which also corresponds to International Application WO 2004/002751 or to U.S. patent application No. 2004/052569.

In addition, the optical proximity sensor 5 and the processor unit 6 of the writing instrument 1 can be adapted such that the processor unit 6 stores in a memory the various measurements taken by the optical proximity sensor 5. The processor unit 6 can, for example, be adapted to cause the optical proximity sensor 5 to perform distance evaluation or measurement operations that are repeated at predetermined time intervals. For example, said time intervals could lie in the range 1 millisecond to 0.1 milliseconds so that the processor unit 6 can compare the various measured since values in order to determine whether a difference in distance is representative of the writing instrument being moved or displaced irrelative to the writing medium 8. In which case, when the processor unit 6 determines that the distance evaluated by means of the optical sensor 5 lies within a suitable range, and that the writing instrument is being moved, by means of non-zero difference in measured distances, the processor unit 6 can then activate and/or influence operation of the spray head 43, e.g. by modulating the frequency and/or the amplitude of the control signals sent to the spray head 43.

The invention claimed is:

1. An optical proximity sensor adapted to be mounted in a liquid-jet instrument having a spray head for spraying a jet of liquid, the optical sensor serving to evaluate a distance between the optical sensor and a given surface onto which the liquid is to be sprayed, the optical proximity sensor comprising:

a printed circuit having a first face and a second face on which at least one light-emitting element and at least one light-receiving element are positioned, the light-emitting and the light-receiving elements being adapted to evaluate the distance between the light-emitting and the light-receiving elements, and the given surface;

an intermediate part mounted on the second face of the printed circuit, and includes at least two through recesses in which the light-emitting and the light-receiving elements of the printed circuit are received; and protective means that cover at least one of the two through recesses, the protective means presenting optical properties adapted to the wavelength of the light used by the light-emitting and the light-receiving elements so as to enable the light to be focused, wherein the printed circuit and the intermediate part are provided with through holes which are mutually superposed to form a passageway serving to enable the liquid to be sprayed from the liquid spray head.

2. The optical sensor according to claim 1, wherein the printed circuit further comprises a rigid board disposed against the intermediate part, and conductive tracks formed on the first face of the printed circuit.

3. The sensor according to claim 2, wherein the printed circuit is a flexible strip that is secured to the intermediate part, and includes conductive tracks formed on the second face of the printed circuit.

4. The sensor according to claim 3, wherein the conductive tracks are adapted to power the light-emitting and the light-receiving elements, and to convey the signals from the at least one light-receiving element to a processor unit.

5. The sensor according to claim 1, wherein the printed circuit and the intermediate part are fastened together by adhesive bonding.

6. The sensor according to claim 1, wherein the intermediate part and the protective means are fastened together by adhesive bonding.

7. The optical sensor according to claim 1, wherein the second face of the printed circuit is provided with a plurality of light-emitting and light-receiving elements, wherein the intermediate part is provided with a plurality of through recesses in which the plurality of light-emitting and light-receiving elements are received, and wherein the protective means cover the plurality of recesses.

8. The sensor according to claim 7, wherein the protective means include a transparent plate.

9. The sensor according to claim 8, wherein the transparent plate is obtained directly by overmolding a transparent material on the intermediate part.

10. The sensor according to claim 1, wherein a refractive matching material is disposed between the protective means, and the light-emitting and light-receiving elements.

11. The sensor according to claim 10, wherein the refractive matching material is made of a rubber based silicon.

12. The sensor according to claim 8, wherein the protective means cover the at lest one through recess in which the at least one light-emitting element is received, the protective means presenting optical properties adapted to the wavelength of the light used in order to enable the emitted light to be focused on the given surface.

13. The sensor according to claim 8, wherein the protective means cover the at least one recess in which the at least one light-receiving elements is received, the protective means having optical properties adapted to the wavelength of the light used in order to enable the received light to be focused towards the at least one light-receiving element.

14. The sensor according to claim 1, having at least two light-receiving elements, in which the protective means include a first zone adapted to focus the received light towards the at least two light-receiving elements in a first manner, and a second zone adapted to focus the received light towards the other of the at least two light-receiving elements in a manner different from the first manner, and so that the light received by each of the at least two elements has different characteristics.

15. The sensor according to claim 14, wherein the first and second zones of the protective means are respectively first and second facets presenting profiles that are different.

16. The sensor according to claim 1, wherein a light barrier is arranged between the at least one light-emitting element and the at least one light-receiving element.

17. The sensor according to claim 16, wherein the intermediate part includes a front face which is on the opposite side from its face facing the printed circuit and in which the through recesses open out, and in which sensor the light barrier comprises a projection arranged on the front face of the intermediate part between the outlet of a recess in which the at least one light-emitting element is received and the outlet of a recess in which the at least one light-receiving element is received.

18. The sensor according to claim 17, wherein the projection extends across the front face and subdivides the face into a first portion in which all of the recesses receiving light-emitting elements open out, and a second portion in which all of the recesses receiving light-receiving elements open out.

19. The sensor according to claim 1, wherein the protective means comprise at least one one-piece part, the one-piece part covering only those recesses which receive light-emitting elements, or only those recesses which receive light-receiving elements.

20. The sensor according to claim 1, wherein the protective means are provided with a through hole superposed on the through holes in the printed circuit and in the intermediate part.

21. The sensor according to claim 19, wherein the recesses in the intermediate part have walls shaped to optimize the guiding of the light emitted by the at least one light-emitting element and received by the at least one light-receiving element.

22. An optical proximity sensor adapted to be mounted in a liquid-jet instrument having a spray head for spraying a jet of liquid, the optical sensor serving to evaluate a distance between the optical sensor and a given surface onto which the liquid is to be sprayed, the optical proximity sensor comprising:

a printed circuit having a first face and a second face on which at least one light-emitting element and at least one light-receiving element are positioned, the light-emitting and the light-receiving elements being adapted to evaluate the distance between the light-emitting and the light-receiving elements, and the given surface;

an intermediate part mounted on the second face of the printed circuit, and includes at lest two through recesses in which the light-emitting and the light-receiving elements of the printed circuit are received; and protective means that cover at least one of the two through recesses, the protective means presenting optical properties adapted to the wavelength of the light used by the light-emitting and the light-receiving elements so as to enable the light to be focused, wherein the printed circuit and the intermediate part are provided with through holes which are mutually superposed to form a passageway serving to enable the liquid to be sprayed from the liquid spray head, wherein the printed circuit further comprises a rigid board disposed against the intermediate part, and conductive tracks formed on the first face of the printed circuit, and wherein the conductive tracks are adapted to power the light-emitting and the light-receiving elements, and to convey the signals from the at least one light-receiving element to a processor unit.

23. An optical proximity sensor adapted to be mounted in a liquid-jet instrument having a spray head for spraying a jet of liquid, the optical sensor serving to evaluate a distance between the optical sensor and a given surface onto which the liquid is to be sprayed, the optical proximity sensor comprising:

a printed circuit having a first face and a second face on which at least one light-emitting element and at least one light-receiving element are positioned, the light-emitting and the light-receiving elements being adapted to evaluate the distance between the light-emitting and the light-receiving elements, and the given surface;

an intermediate part mounted on the second face of the printed circuit, and includes at least two through recesses in which the light-emitting and the light-receiving elements of the printed circuit are received; and protective means that cover at least one of the two through recesses, the protective means presenting optical properties adapted to the wavelength of the light used by the light-emitting an the light-receiving elements so as to enable the light to be focused, wherein the printed circuit and the intermediate part are provided with through holes which are mutually superposed to form a passageway serving to enable the liquid to be sprayed from the liquid spray head, wherein the printed circuit further comprises a rigid board disposed against the intermediate part, and conductive tracks formed on the first face of the printed circuit, wherein the conductive tracks are adapted to power the light-emitting and the light-receiving elements, and to convey the signals from the at least one light-receiving element to a processor unit, wherein the second face of the printed circuit is provided with a plurality of light-emitting and light-receiving elements, wherein the intermediate part is provided with a plurality of through recesses in which the plurality of light-emitting and light-receiving elements are received, wherein the protective means cover the plurality of recesses, and wherein the protective means include a transparent plate.

* * * * *